US006218088B1

(12) United States Patent
Arakawa

(10) Patent No.: US 6,218,088 B1
(45) Date of Patent: Apr. 17, 2001

(54) COLOR IMAGE FORMATION METHOD USING SILVER HALIDE PHOTOGRAPHIC MATERIAL

(75) Inventor: Jun Arakawa, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/393,713

(22) Filed: Sep. 10, 1999

(30) Foreign Application Priority Data

Sep. 11, 1998 (JP) ..... 10-258908

(51) Int. Cl.[7] ..... G03C 7/30

(52) U.S. Cl. ..... 430/351; 430/348; 430/349; 430/404; 430/405; 430/415; 430/448

(58) Field of Search ..... 430/348, 349, 430/351, 404, 405, 415, 448

(56) References Cited

U.S. PATENT DOCUMENTS 5,756,269 * 5/1998 Ishikawa et al. ..... 430/351
5,756,275 * 5/1998 Takizawa et al. ..... 430/351
5,851,749 * 12/1998 Okawa et al. ..... 430/566
5,965,332 * 10/1999 Kikuchi ..... 430/351
5,976,771 * 11/1999 Kosugi et al. ..... 430/351
6,001,543 * 12/1999 Asami et al. ..... 430/351
6,013,421 * 1/2000 Nakamura et al. ..... 430/351

FOREIGN PATENT DOCUMENTS 10-20457 1/1998 (JP) .

* cited by examiner

*Primary Examiner*—Hoa Van Le
(74) *Attorney, Agent, or Firm*—Burns, Doane, Swecker & Mathis, LLP

(57) ABSTRACT

An image formation method for forming a color image by imagewise exposing a color negative type silver halide photographic material comprising a transparent support having provided thereon at least three kinds of light-sensitive layers, followed by development processing at a temperature of 50° C. or more, which comprises the steps of reading with an imaging apparatus an image obtained from the color negative type silver halide photographic material whose sensitivity and gradient satisfy the following relationship, applying digital image processing thereto, and then, obtaining output signals of three or more colors:

$$1.0 \leqq (\log_{10} S) \cdot \gamma \leqq 2.5$$

$$S \geqq 800$$

wherein S represents an ISO sensitivity, and γ represents an average gradient of the three kinds of light-sensitive layers, thereby inviting no failure in shooting due to insufficient exposure in a compact camera or a film with lens, and forming a color image of high quality.

7 Claims, 1 Drawing Sheet

COLOR IMAGE FORMATION METHOD USING SILVER HALIDE PHOTOGRAPHIC MATERIAL

FIELD OF THE INVENTION

The present invention relates to a method for obtaining excellent color images under wide shooting conditions by development processing and digital image processing of color negative type silver halide shooting materials having the specific relationship between the sensitivity and the gradient under specified conditions.

BACKGROUND OF THE INVENTION

With recent miniaturization (compactness) of cameras, miniaturization of built-in electronic flushes also rapidly proceeds, and the problem of underexposure caused by insufficient quantity of light is pointed out in color shooting materials. Further, with a recent reduction in format as employed in the APS, improvement in image quality also becomes more important than hitherto, so that color negative type shooting materials high in sensitivity and image quality have been eagerly desired.

On the other hand, the spread of lens-mounted film (film with lens) is remarkable, and smallness in size, lightness in weight and simple operation thereof have been supported by consumers. In the case of lens-mounted films, the insufficient quantity of light of electronic flushes particularly introduces a problem because of restrictions of smallness in size and low cost. It has been therefore a very important problem to increase the sensitivity of shooting light-sensitive materials.

For the lens-mounted films having no diaphragm mechanisms, however, the increased sensitivity of shooting light-sensitive materials results in too much exposure under the snow mountain or fine weather conditions in summer, which causes too high density of color negative films of the shooting light-sensitive materials. Accordingly, printing with an automatic printer takes a tremendous period of time. Alternatively, the density exceeds the reading density range of a CCD, so that it can not be read even by a digital printer. As described above, the serious problems have become clear.

For solving these problems, various lens-mounted films having diaphragm mechanisms have been devised. However, they can not be actually used, because they increase costs and impair the simplicity of operation.

Further, a method is also considered in which the gradation of shooting light-sensitive materials is softened to prevent the negative density from increasing too high even by shooting under high illumination. However, in such light-sensitive materials, the contrast becomes extremely low by shooting under normal or low illumination, which introduces a serious problem.

Furthermore, a process of reading the above-mentioned soft (low contrast) light-sensitive materials using a scanner mounted on a digital printer, and treating digitalized signals to adjust the contrast properly has also recently been proposed. However, when this process is actually performed, the granularity is significantly deteriorated at the stage that the contrast is emphasized by image processing, and particularly, a region decreased in exposure does not stand practical use.

SUMMARY OF THE INVENTION

An object of the present invention to provide a color negative type shooting light-sensitive material which invites no failure in shooting due to insufficient exposure in a compact camera or a film with lens, and for forming a color image of high quality.

Another object of the present invention is to provide an image formation method using the above-mentioned shooting light-sensitive material.

The above-mentioned problems have been solved by the following method.

That is to say, the present invention provides:

(1) an image formation method for forming a color image by imagewise exposing a color negative type silver halide photographic material comprising a transparent support having provided thereon at least three kinds of light-sensitive layers, followed by development processing at a temperature of 50° C. or more, which comprises the steps of reading with an image taking apparatus (imaging apparatus) an image obtained from the color negative type silver halide photographic material whose sensitivity and gradient satisfy the following relationship, applying digital image processing thereto, and then, obtaining output signals of three or more colors:

$$1.0 \leqq (\log_{10} S) \cdot \gamma \leqq 2.5$$

$$S \geqq 800$$

wherein S represents an ISO sensitivity, and γ represents an average gradient of the three kinds of light-sensitive layers; and (2) the image formation method described in the above (1), wherein the color negative type silver halide photographic material is imagewise exposed using the photographic material and a processing member comprising a support having provided thereon at least a processing layer containing a base and/or a base precursor, water corresponding to 0.1 to 1.0 time an amount necessary for swelling all coated layers except for back layers of both the photographic material and the processing member at their maximum is given to the photographic material and/or the processing member, and then, the photographic material is overlaid with the processing member in the form that the light-sensitive layer and the processing layer face each other, followed by heating at a temperature of 50° C. to 100° C. for 5 seconds to 60 seconds to form a color image.

DETAILED DESCRIPTION OF THE INVENTION

Figure 1:
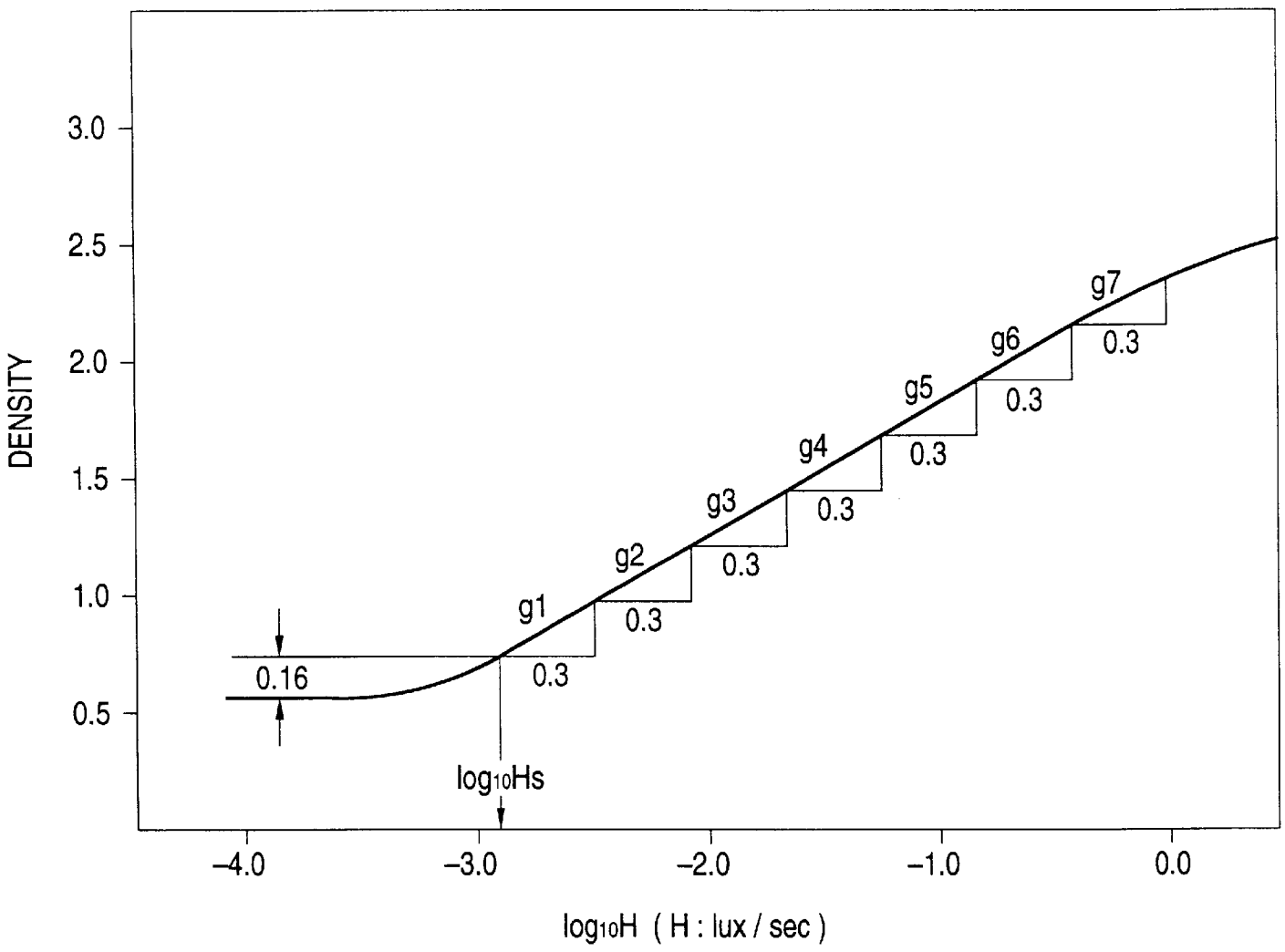
FIG. 1 is a characteristic curve (H-D curve) showing how to determine the gradient.

The ISO sensitivity used in the present invention is determined according to the ANSI (American National Standard) PH 2.27 (1988) "Determination of ISO Sensitivity of Color Negative Films Used in Still Photographs".

However, the value of the ISO sensitivity depends on the processing agent, time, temperature, stirring, processing apparatus and processing process, so that it is required that the processing method is specified in detail in addition to the above-mentioned standard, apart therefrom, for determining the absolute value of the ISO sensitivity.

In the present invention, the ISO sensitivity and the gradient are specified by treating the photographic material and the processing process as one set. The ISO sensitivity is measured according to the above-mentioned ANSI PH 2.27 with the exception that the photographic material is developed at a developing temperature of 50° C. or more in accordance with a formulation used when the photographic material is actually processed.

For expressing a natural atmosphere even by shooting at evening and night, the sensitivity of color negative photographic materials is required to be 800 or more, and preferably 1600 or more, by the ISO sensitivity.

The average gradient used in the present invention is described below.

The gradient is determined by subjecting the photographic material to required development processing, conducting sensitometry in a manner similar to that used for determining the ISO sensitivity, and calculating the gradient by the method shown in FIG. 1 from an exposure H vs. density D curve thus obtained.

That is to say, the sensitivity point $\log_{10}Hs$ determined by the above-mentioned method is decided as an origin, and each slope g is determined at intervals of 0.3 of $\log_{10}H$ as the following equation:

$$gi=di/0.3$$

Here, the arithmetic mean from g1 to g7 is taken as the gradient.

However, narrower variation in slopes g1 to g7 is more preferred, and it is particularly preferred that the value of the standard deviation divided by the mean value, namely the coefficient of dispersion, is 0.2 or less.

For sensitometry curves (H vs. D curves) of red filter density measurement, green filter density measurement and blue filter density measurement, respectively, the above-mentioned gradients G(R), G(G) and G(B) are determined, and the arithmetic mean of these three values is the average gradient γ specified in the present invention.

The values of G(R), G(G) and G(B) are preferably as uniform as possible, and the range from the maximum value to the minimum value of these three values is more preferably within 20% of the average.

The present inventors have discovered that it is suitable for color negative photographic materials for cameras having no diaphragm mechanisms and films with lens to specify the product of the average gradient y and $\log_{10}S$ between 1.0 and 2.5 as the present invention. The range of the product of the average gradient γ and $\log_{10}S$ is more preferably from 1.3 to 2.0.

Further, the present inventors have discovered that it is insufficient in the present invention only to satisfy the product of the average gradient γ and $\log_{10}S$, and that images of high quality are obtained by developing exposed photographic materials at a temperature of 50° C. or more which is higher than that ordinarily used, electrically reading the images with an image taking apparatus, and outputting them after image processing.

Although it has become possible to shorten the processing time, to increase the sensitivity and to enhance the image quality by development processing at a high temperature of 50° C. or more for the color negative photographic materials of the present invention, the processing temperature is preferably 60° C. or more, and particularly preferably 80° C. or more. The upper limit of the processing temperature is preferably 100° C. or less.

As the form of development processing, conventional methods can be used in which exposed photographic materials are immersed in aqueous solutions of developing agents, bases and the like in water. However, methods are also preferred in which exposed photographic materials are coated with viscous paste prepared from aqueous solutions of developing agents, bases and the like in water.

Further, methods are also preferred in which photographic materials containing developing agents together with couplers are immersed in aqueous solutions of bases or coated with paste-like bases after shooting.

Furthermore, methods are particularly preferably used in which using processing members comprising supports having provided thereon at least processing layers containing bases and/or base precursors, exposed photographic materials are overlaid with the processing members in the form that light-sensitive layers and processing layers face each other, allowing small amounts of fountain solutions to intervene therebetween, followed by heating to conduct development processing. In this case, water provided between the light-sensitive layers and the processing layers is preferably given to the light-sensitive layers or the processing layers in amounts corresponding to 0.1 to 1.0 time amounts necessary for swelling all coated layers except for back layers of both the photographic materials and the processing members at their maximum.

On the other hand, for the amount of silver coated of the color negative photographic materials, a higher silver amount generally results in higher sensitivity and higher granularity, but conversely, in inferior sharpness and inferior anti-deterioration performance of the photographic materials during storage. Accordingly, the amount of silver coated of ordinary high-sensitive color negative photographic materials is within the range of 7 $g/m^2$to 12 $g/m^2$. In the present invention, however, the photographic materials are developed at high temperatures, so that high sensitivity and fine granularity are obtained even at low silver amounts. It has therefore become clear that a reduction in the amount of silver becomes possible, which causes significant improvements in sharpness and toughness of the photographic materials (raw stock storability and latent image storability). Accordingly, in the present invention, the amount of silver coated is preferably with in the range of 2 g $m^2$ to 7 $g/m^2$, and particularly preferably with in the range of 3 $g/m^2$ to 5 $g/m^2$.

Then, methods from reading of images of the photographic materials after development processing to outputting to output materials after image processing are described bellow. in the image taking apparatuses used for image reading of processed photographic materials, photoelectric elements are used as sensors, and CCD arrays are preferably used. As the CCD arrays, area type CCD sensors are also preferably used.

Further, it is preferred that the image taking (imaging) apparatuses comprise AID converting means, correcting means for correcting the CCD arrays, and further converting means for conducting logarithmic conversion of color image signals, to the color image signals detected by the CCD arrays.

It is preferred that the image taking apparatuses are constituted so as to first carry out prescanning for reading images of films at rough intervals to rapidly obtain rough information of the whole images, followed by fine scanning for reading the images at high resolution.

The color image data incorporated by such scanning preferably further have image-processed portions. The contents of the image processing preferably include gradation changes, emphasis on sharpness, inhibition of granulation, color correction and dodging processing. Further, it is more preferred that results of such image processing are successively displayed on a monitor to increase the convenience of users.

The digital image data subjected to the image processing can be outputted to various output means to obtain color images. Methods of writing the data on output materials using laser beams or LED light are preferred. As the output materials, color paper can be preferably used, but dry color print systems such as Pictrostat 3000, Pictrography 3000 and Pictrography 4000 manufactured by Fuji Photo Film Co., Ltd., which have high image quality in spite of no substantial use of processing solutions, are particularly preferred.

Preferred embodiments of the present invention will be described in greater detail below.

In the present invention, the color negative photographic material is used which comprises a transparent support having provided thereon at least three kinds of light-sensitive layers each containing light-sensitive silver halide grains, couplers and binders and different from one another in the light-sensitive wavelength region and/or the absorption wavelength region of dyes formed from the above-mentioned color developing agents and the couplers. It is also possible to supply the color developing agents from the outside to the photographic material in the form of processing solution or processing paste in the processing stage. However, it is preferred that the photographic material contains the color developing agents together with the couplers in the coexisting form.

Further, it is also possible to supply the base and the base precursor from the outside to the photographic material in the form of processing solution or processing paste. However, the method is preferably used in which using the processing member comprising the support having provided thereon at least the processing layer containing the base and/or the base precursor, the base and/or the base precursor is supplied by overlaying the photographic material with the processing member in the form that the light-sensitive layer and the processing layer face each other, in the presence of water corresponding to 0.1 to 1.0 time an amount necessary for swelling all coated layers except for back layers of both the photographic material and the processing member at their maximum.

Silver halides which can)De used in the photographic materials of the present invention may be any of silver iodobromide, silver bromide, silver chlorobromide, silver iodochloride, silver chloride and silver iodochlorobromide. The size of silver halide grains is preferably from 0.1 $\mu$m to 2 $\mu$m and particularly from 0.2 $\mu$m to 1.5 $\mu$m in terms of the diameter of a sphere equivalent to a grain volume. They are used as the above-mentioned light-sensitive silver halide grains, and can also be used light-insensitive silver halide grains without chemical sensitization.

The silver halide grains may have a regular crystal form such as a cubic, an octahedral or a tetradecahedral form, or a tabular form such as a hexagonal or a rectangular form. Of these, tabular grains having an aspect ratio of 2 or more, preferable 8 or more, more preferably 20 or more are preferred, said aspect ratio being a value of the projected diameter of grains divided by the thickness of grains, and emulsions are preferably used in which such tabular grains occupy 50% or more, preferably 80% or more, and more preferably 90% or more, of the projected area of the whole grains.

The thickness of these tabular grains is preferably 0.3 $\mu$m or less, more preferably 0.2 $\mu$m or less and most preferably 0.1 $\mu$m or less.

Grains having a grain thickness of less than 0.07 $\mu$m and a high aspect ratio described in U.S. Pat. Nos. 5,494,789, 5,503,970, 5,503,971 and 5,536,632 can also be preferably used.

Further, tabular high silver chloride grains having a (111) face as a main face described in U.S. Pat. Nos. 4,400,463, 4,713,323 and 5,217,858, and tabular high silver chloride grains having a (100) face as a main face described in U.S. Pat. Nos. 5,264,337, 5,292,632 and 5,310,635 can also be preferably used.

Examples of these silver halide grains actually used are described in Japanese Patent Application Nos. 8-46822 (JP-A-9-274295), 8-97344 (JP-A-9-319047), 8-238672 (JP-A-10-115888) and 9-41637 (JP-A-10-221827). The silver halide grains used in the present invention are preferably so-called monodisperse grains which are narrow in grain size distribution. As a measure of the monodispersibility, the coefficient of variation is preferably 25% or less, and more preferably 20% or less, wherein the coefficient of variation is obtained by dividing the standard deviation by the mean grain size. Further, it is preferred that the halogen composition is uniform between the grains.

The silver halide grains used in the present invention may be constituted so as to be uniform in the halogen composition in the grains, or sites different in the halogen composition may be intentionally introduced. In particular, for obtaining high sensitivity, grains having the laminated structure composed of cores and shells different from each other in the halogen composition are preferably used. Further, it is preferred that regions different in the halogen composition are introduced, followed by further growth of gains to intentionally introduce dislocation lines. Furthermore, it is also preferred that guest crystals different in the halogen composition may bet connected to vertexes or edges of host grains by epitaxial junction.

The inside of the silver halide grains used in the present invention is also preferably doped with multivalent transition metal ions or multivalent anions as impurities. In particular, in the former case, halogeno complexes having elements of the iron group as center metals, cyano complexes and organic ligand complexes are preferably used.

Usually, emulsions used in the present invention are preferably subjected to chemical sensitization and spectral sensitization.

As the chemical sensitization, chalcogen sensitization using sulfur, selenium or tellurium compounds, noble metal sensitization using gold, platinum, iridium and the like, or so-called reduction sensitization in which reducing silver nuclei are introduced using compounds having appropriate reducing properties during grain formation, thereby obtaining high sensitivity, can be used either alone or in various combinations thereof.

In the spectral sensitization, so-called spectral sensitizing dyes such as cyanine dyes, merocyanine dyes, complex cyanine dyes, complex merocyanine dyes, holopolar dyes, hemicyanine dyes, styryl dyes and hemioxonol dyes, which give the sensitivity to the absorption wavelength region of themselves, are used either alone or in combination. It is also preferred that they are used together with supersensitizers.

Various stabilizers are preferably added to the silver halide emulsions used in the present invention for preventing fog, or enhancing stability during storage. Examples of such stabilizers include nitrogen-containing heterocyclic compounds such as azaindenes, triazoles, tetrazoles and purines, and mercapto compounds such as mercaptotriazoles, mercapto tetrazoles, mercaptoimidazoles and mercapto-thiadiazoles. In particular, triazoles or mercaptoazoles having alkyl of 5 or more carbon atoms or aromatic rings as substituent groups exhibit an significant effect of preventing fog in heat development, enhancing the development performance of exposed areas in some cases, and giving high discrimination. Photographic additives for silver halide emulsions described in *Research Disclosure,* No. 17643 (December, 1978), ibid., No. 18716 (November, 1979), ibid., No. 307105 (November, 1989) and ibid., No. 38957 (September, 1996) can be preferably used.

Binders of the photographic materials are preferably hydrophilic binders, and examples thereof include binders described in the above-mentioned Research Disclosures and JP-A-64-13546 (the term "JP-A" as used herein means an "unexamined published Japanese patent application"), pages 71 to 75. Of these, gelatin and a combination of gelatin and another water-soluble binder, for example, polyvinyl alcohol, modified polyvinyl alcohol, a cellulose derivative or an acrylic polymer are preferred. The amount of binder coated is from 1 $g/m^2$ to 20 $g/m^2$, preferably from 2 $g/m^2$ to 15 $g/m^2$, and more preferably 3 $g/m^2$ to 12 $g/m^2$. Gelatin is used at a rate of 50% to 100%, preferably 70% to 100% in the binder.

Examples of the color developing agents include p-phenylenediamine compounds and p-aminophenol compounds. More preferred examples thereof include sulfonamidophenols described in JP-A-8-110608, JP-A-8-122994, JP-A-8-146578, JP-A-!)-15808 and 9-146248, sulfonylhydrazines described in EP-A-545491, JP-A-8-166664 and JP-A-8-227131, carbamoylhydrazines described in JP-A-8-286340, sulfonylhydrazones described in JP-A-8-202002 and Japanese Patent Application Nos. 8-357191 (JP-A-10-186564) and 9-365629 (JP-A-10-239793), and carbamoylhydrazones described in JP-A-8-234390.

The color developing agents are used either alone or as a combination of two or more of them, and the total amount of them used is suitably from 0.05 $mmol/m^2$ to 20 $mmol/m^2$, and preferably from 0.1 $mmol/m^2$ to 10 $mmol/m^2$. In the photographic materials, couplers which react with oxidized products of the above-mentioned color developing agents by coupling to form dyes are used. Preferred examples thereof include compounds generically named active methylene, 5-pyrazolone, pyrazoloazole, phenol, naphthol and pyrrolotriazole. Specific examples thereof which can be preferably used in the present invention include compounds cited in *Research Disclosure,* No. 38957 (September, 1996), pages 616 to 624. Particularly preferred examples thereof include pyrazoloazole couplers as described in JP-A-8-110608 and pyrrolotriazole couplers as described in JP-A-8-122994 and JP-A-9-218496.

These couplers are generally used in an amount of 0.05 $mmol/m^2$ to 10 $mmol/m^2$, and preferably in an amount of 0.1 $mmol/m^2$ to 5 $mmol/m^2$, for each color.

Further, colored couplers for correcting unnecessary absorption of forming dyes, and photographically useful compounds reacting with the oxidized developing agents, for example, compounds releasing developing inhibitors (including couplers), can also be used.

The photographic material is usually composed of three or more kinds of light-sensitive layers different from one another in color sensitivity. Each of the light-sensitive layers contains at least one silver halide emulsion layer, and as a typical example, each layer is composed of a plurality of silver halide emulsion layers substantially identical to one another in color sensitivity, but different from one another in light sensitivity. In this case, when the silver halide grains having a larger projected diameter of grains are used, the so-called aspect ratio obtained by dividing the projected diameter of grains by the thickness of grains is preferably higher. The light-sensitive layer is a unit light-sensitive layer having color sensitivity to some of blue, green and red lights. In general, in the unit light-sensitive layer of the multilayer silver halide color photographic material, the red-sensitive layer, the green-sensitive layer and the blue-sensitive layer are arranged from the support side in this order. However, the above-described order of arrangement may be reversed, or such an arrangement that a layer having a different color sensitivity is sandwiched between layers having the same color sensitivity may also be adopted, depending on its purpose. The total film thickness of the light-sensitive layers is generally from 1 $\mu$m to 20 $\mu$m, and preferably from 3 $\mu$m to 15 $\mu$m.

In the present invention, yellow filter layers, magenta filter layers and antihalation layers can be used as colored layers in which oil-soluble dyes discolorable by processing are used. For example, when the red-sensitive layer, the green-sensitive layer and the blue-sensitive layer are arranged from the side closest to the support in this order in the light-sensitive layer, the yellow filter layer can be provided between the blue-sensitive layer and the green-sensitive layer, the magenta filter layer between the green-sensitive layer and the red-sensitive layer, and the cyan filter layer (antihalation layer) between the red-sensitive layer and the support. These colored layers may be directly in contact with emulsion layers, or may be arranged on intermediate layers such as gelatin layers formed on the emulsion layers. The amount of dyes used is selected so as to give a transmission density of 0.03 to 3.0, more preferably 0.1 to 1.0 to each of blue, green and red lights for each layer. Specifically, the dyes are used in an amount of 0.005 $mmol/m^2$ to 2.0 $mmol/m^2$, and more preferably in an amount of 0.05 $mmol/m^2$ to 1.0 $mmol/m^2$, although depending on $\epsilon$ and the molecular weight of the dyes.

Preferred examples of the dyes used include ketomethylene compounds (for example, 2-pyrazoline-5-one, 1,2,3,6-tetrahydropyridine-2,6-dione, rhodanine, hydantoin, thiohydantoin, 2,4-oxazolidinedione, isooxazolone, barbituric acid, thiobarbituric acid, indandione, dioxopyrazolopyridine, hydroxypyridine, pyrazolidinedione, 2,5-dihydrofuran-2-one and pyrroline-2-one) described in Japanese Patent Application No. 8-329124 (JP-A-10-207027); compounds each composed of a methylene group and two kinds of an acidic nucleus, a basic nucleus, an aryl group and a heterocyclic group, the acidic nucleus being composed of a compound having a methylene group held between electron attractive groups (for example, a methylene group held between —CN, $—SO_2R_1$, $—COR_1$, $—COOR_1$, $CON(R_2)_2$, $—SO_2N(R_2)_2$, $—C[=C(CN)_2]R_1$ and $—C[=C(CN)_2]N(R_1)_2$, wherein $R_1$ represents an alkyl group, an alkenyl group, an aryl group, a cycloalkyl group or a heterocyclic group, and $R_2$ represents a hydrogen atom or the group described for $R_1$), the basic group including, for example, pyridine, quinoline, indolenine, oxazole, imidazole, thiazole, benzoxazole, benzimidazole, benzothiazole, oxazoline, naphthoxazole and pyrrole, the aryl group including, for example, a phenyl group and a naphthyl group, and the heterocyclic group including, for example, pyrrole, indole, furan, thiophene, imidazole, pyrazole, indolidine, quinoline, carbazole, phenothiazine, phenoxadine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin and coumarone; and $(NC)_2C{=}C(CN)—R_3$ (wherein $R_3$ represents an aryl group or a heterocyclic group).

In the photographic material of the present invention, two or more dyes may be used as a mixture in one colored layer. For example, three kinds of yellow, magenta and cyan dyes can also be used as a mixture in the above-mentioned antihalation layer.

Preferably, a decoloring dye is used in the state that oil droplets in which the dye is dissolved in an oil and/or an oil-soluble polymer are dispersed in a hydrophilic binder. The preparation method thereof is preferably an emulsifying dispersion method, for example, a method described in U.S. Pat. No. 2,322,027. In this case, high boiling oils as described in U.S. Pat. Nos. 4,555,470, 4,536,466, 4,587,206, 4,555,476and 4,599,296, and JP-B-3-62256 (the term "JP-B" as used herein means an "examined Japanese patent publication") can be used in combination with low boiling organic solvents having a boiling point of 50° C. to 160° C. if necessary. Further, the high boiling oils can be used as a combination of two or more of them. Furthermore, oil-soluble polymers can be used instead of the oils or in combination with them, and examples thereof are described in PCT International Publication No. WO88/00723. The high boiling oils and/or the oil-soluble polymers are used in an amount of 0.01 g to 10 g, and preferably in an amount of 0.1 g to 5 g, per g of dye used.

The dyes can also be dissolved in the polymers by latex dispersion methods, and specific examples of processes thereof and latexes for immersion are described in U.S. Pat. No. 4,199,363, West German Patent Publication (OLS) U.S. Pat. Nos. 2,541,274 and 2,541,210, JP-B-53-41091 and EP-A-029104.

When the oil droplets are dispersed in the hydrophilic binders, various surfactants can be used. For example, surfactants described in JP-A-59-157636, pages 37 and 38, and Kouch Gijutsu, (known art), No. 5 (published by Aztech Co., Ltd., May 22, 1991), pages 136 to 138 can be used. Further, phosphoric ester type surfactants described in Japanese Patent Application Nos 5-204325 (JP-A-7-56267) and 6-19247 (JP-A-7-228589) and West German Patent Publication (OLS) No. 932299A can also be used.

As the hydrophilic binders, water-soluble polymers are preferred. Examples thereof include natural compounds such as proteins, for example, gelatin and gelatin derivatives, and polysaccharides, for example, cellulose derivatives, starch, gum arabic, dextran and pulluran, and synthetic polymers such as polyvinyl alcohol, polyvinylpyrrolidone and acrylamide polymers. These water-soluble polymers can also be used as a combination of two or more of them. It is particularly preferred that they are combined with gelatin. Gelatin is selected from lime-treated gelatin, acid-treated gelatin and so-called decalcified gelatin in which the amount of calcium and the like is decreased, and can also be used in combination.

The dyes decolor in the presence of decoloring agents in processing. The decoloring agents include alcohols or phenols, amines or aniline compounds, sulfinic acid or salts thereof, sulfurous acid or salts thereof, thiosulfuric acid or salts thereof, carboxylic acids or salts thereof, hydrazines, guanidine compounds, aminoguanidine compounds, amidines, thiols, cyclic or chain active methylene compounds, cyclic or chain active methine compounds, and anionic species derived from these compounds.

Of these, hydroxyamines, sulfinic acid, sulfurous acid, guanidine compounds, aminoguanidine compounds, heterocyclic thiols, cyclic or chain active methylene compounds and active methine compounds are preferably used, and guanidine compounds and aminoguanidine compounds are particularly preferred.

The above-mentioned decoloring agents are considered to come in contact with the dyes in processing to decolor the dyes by nucleophilic addition to dye molecules. Preferably, after or concurrently with imagewise exposure, the silver halide photographic materials containing the dyes are overlaid with the processing members containing the decoloring agents or precursors thereof in the presence of water so that the layers face each other, followed by heating. Then, both are separated from each other, thereby obtaining developed color images on the silver halide photographic materials and decoloring the dyes. In this case, the density of the dyes after decolorization is ⅓ or less, and preferably ⅕ or less the original density. The amount of the decoloring agents is from 0.1-fold mol to 200-fold, and preferably from 0.5-fold mol to 100-fold mol, in relation to that of the dyes.

The silver halides, the color developing agents and the couplers may be contained either in the same layers or in different layers. In addition to the light-sensitive layers, protective layers, undercoat layers, intermediate layers and light-insensitive layers such as the above-mentioned yellow filter layers and antihalation layers may be provided, and back layers may be provided on the back sides of the supports. The thickness of the total layers formed on the light-sensitive layer side is from 3 $\mu$m to 25 $\mu$m, and preferably from 5 $\mu$m to 20 $\mu$m.

For various purposes, hardeners, surfactants, photographic stabilizers, antistatic agents, lubricants, matte agents, latexes, formalin scavengers, dyes and UV absorbers can be used in the photographic materials. Specific examples thereof are described in the above-mentioned Research Disclosures and Japanese Patent Application No. 8-30103 (JP-A-9-204,031). Particularly preferred examples of the antistatic agents are fine grains of metal oxides such as ZnO, $TiO_2$, $SnO_2$, $Al_2O_3$, $In_2O_3$, $SiO_2$, MgO, BaO, $MoO_3$ and $V_2O_5$.

As the supports of the photographic materials, photographic supports described in *Shashin Kohgaku no Kiso* (*Higinen Shashin* [*The Fundamentals of Photographic Engineering* (*Nonsilver Photoraph*)], pages 223 to 240, edited by Nippon Shashin Gakkai, Corona Publishing Co Ltd. (1979) are preferred. Specific examples of materials used for the supports include polyethylene terephthalate, polyethylene naphthalate, polycarbonates, syndiotactic polystyrene, cellulose derivatives (for example, triacetyl cellulose).

These supports can be subjected to heat treatment (control of the degree of crystallinity and orientation), uniaxial or biaxial stretching (control of orientation), blending with various polymers and surface treatment, for improving their optical and physical characteristics.

Further, supports having magnetic recording layers described, for example, in JP-A-4-124645, JP-A-5-40321, JP-A-E-35092 and JP-A-6-31875 are preferably used as the supports to record shooting information. It is also preferred that the back faces of the supports of the photographic materials are coated with water-resistant polymers as described in JP-A-8-292514.

Polyester supports particularly preferably used in the above-mentioned photographic materials having the magnetic recording layers are described in JIII Journal of Technical Disclosure No. 94-6023 (Japan Institute of Invention and Innovation, May 15, 1994) in detail. The thickness of the supports is from 5 $\mu$m to 200 $\mu$m, and preferably from 40 $\mu$m to 120 $\mu$m.

In the present invention, the processing members different from the photographic materials can be used for developing the exposed photographic materials. The processing members contain at least bases and/or base precursors. Most preferred as a system of generating the bases by a combination of slightly water-soluble basic metal compounds described in EP-210660 and U.S. Pat. No. 4,740,445 with compounds which can react with metal ions constituting these basic metal compounds using water as a medium to form complexes In this case, it is preferred that the slightly water-soluble compounds are added to the photographic materials, and that the complex forming compounds are added to the processing members. However, the converse is also possible. Preferred combinations of the compounds include a system of using fine grains of zinc hydroxide in the photographic materials and picolinates such as guanidine picolinate in the processing members.

Mordants may be used in the processing material. In this case, polymer mordants are preferred.

The processing members may be previously allowed to contain physical developing nuclei such as colloidal silver and palladium sulfide as described in Japanese Patent Application No 7-322454, and solvents for silver halides such as hydantoin, and the silver halides of the photographic materials may be solubilized concurrently with development to fix them to the processing members. In addition to these, the processing members may be allowed to contain developing stoppers and printout inhibitors.

Besides the processing layers, the processing members may have protective layers, undercoat layers, back layers and other auxiliary layers. It is preferred that the processing members comprise continuous webs having provided thereon the processing layers, and that even after supplied from feed rolls and used for processing, the processing members are taken up on other rolls without cutting. An example thereof is described in Japanese Patent Application No. 7-240445 (JP-A-9-127670).

There is no limitation on the supports, and plastic films or paper described with regard to the photographic materials can be used. The thickness thereof is from 4 $\mu$m to 120 $\mu$m, and preferably from 6 $\mu$m to 70 $\mu$m. A film over which aluminum is deposited as described in Japanese Patent Application No. 8-52586 (JP-A-9-222690) is can also be preferably used.

As a method for developing the photographic material exposed with a camera, the method is preferably used in which the photographic material is overlaid with the processing member in the form that the light-sensitive layer and the processing layer face each other, in the presence of water corresponding to 0.1 to 1.0 time an amount necessary for swelling all coated layers except for back layers of both the photographic material and the processing member at their maximum, followed by heating at a temperature of 50° C. to 100° C. for 5 seconds to 60 seconds.

As a method for giving water, there is a method of immersing the photographic material or the processing member, and removing excess water with squeeze rollers. Further, a method for spraying water with a water coater comprising a nozzle having nozzle holes linearly arranged at constant intervals along a direction crossing a transferring direction of the photographic material or the processing member, and an actuator for displacing the above-mentioned nozzle toward the photographic material or the processing member on a transferring path, as described in Japanese Patent Application No. 8-196945 (JP-A-10-26817), is also preferred. Further, a method for applying water with a sponge is also preferred.

Heating methods which may be used in the development stage include the contact with a heated block or plate, and the use of a heat roller, a heat drum, an infrared ray or far infrared ray lamp.

In the present invention, another bleaching-fixing stage for further removing the silver halide and developed silver remaining in the photographic material after development is not indispensable. However, for reducing the load of reading image information and enhancing the image storage characteristics, a fixing stage and/or a bleaching stage may be provided. In that case, usual liquid treatment may be used. However, heat treatment together with another sheet coated with a processing agent as described in Japanese Patent Application No. 8-891)77 (JP-A-9-258402) is preferred. In this case, the heating temperature is preferably 50° C. as with the development processing stage, and it is particularly preferred that the temperature is established at the same temperature as that of the development processing stage.

In the present invention, after images are obtained on the photographic materials, color images are obtained on other recording materials based on that information. As a method thereof, image information is photoelectrically read by density measurement of transmitted light, converted to digital signals, and outputted to other recording materials by the signals after image processing. The materials to which the information is outputted may be sublimation type heat-sensitive recording materials, full color direct heat-sensitive recording materials, ink jet materials and electrophotographic materials, as well as light-sensitive materials using silver halides.

The present invention will be illustrated in more detail with reference to examples below, but these are not to be construed as limiting the invention.

EXAMPLE 1

In a reaction vessel, 930 ml of distilled water containing 0.74 g of gelatin having an average molecular weight of 15000 and 0.7 g of potassium bromide was placed, and the temperature was elevated to 40° C. To this solution, 30 ml of an aqueous solution containing 0.34 g of silver nitrate and 30 ml of an aqueous solution containing 0.24 g of potassium bromide were added with vigorous stirring for 20 seconds. After the addition was completed, the temperature was kept at 40° C. for one minute. Then, the temperature of the reaction solution was elevated to 75° C.

After 27.0 g of gelatin was added together with 200 ml of distilled water, 100 ml of an aqueous solution containing 23.36 g of silver nitrate and 80 ml of an aqueous solution containing 16.37 g of potassium bromide were added for 36 minutes while accelerating the addition flow rate. Then, 250 ml of an aqueous solution containing 83.2 g of silver nitrate and an aqueous solution containing potassium iodide and potassium bromide at a molar ratio of 3:97 (the concentration of potassium bromide: 26%) were added for 60 minutes while accelerating the addition flow rate and so that the silver potential of the reaction solution became −20 mV to the saturated calomel electrode. Further, 75 ml of an aqueous solution containing 18.7 g of silver nitrate and a 21.9% aqueous solution of potassium bromide were added for 10 minutes so that the silver potential of the reaction solution became 20 mV to the saturated calomel electrode. After the addition was completed, the temperature was kept at 75° C. for one minute. Then, the temperature of the reaction solution was lowered to 40° C. Then, 100 ml of an aqueous solution containing 10.5 g of sodium p-acetamidobenzenesulfonate iodide monohydrate was added to adjust the pH of the reaction solution to 9.0. Then, 50 ml of an aqueous solution containing 4.3 g of sodium sulfite was added. After the addition was completed, the temperature was kept at 40° C. for 3 minutes. Then, the temperature of the reaction solution was elevated to 55° C. After the pH of the reaction solution was adjusted to 5.8, 0.8 mg of sodium benzenethiosulfinate, 0.04 mg of potassium hexachloroiridate (IV) and 5.5 g of potassium bromide were added, and the temperature was kept at 55° C. for one minute. Then, 180 ml of an aqueous solution containing 44.3 g of silver nitrate and 160 ml of an aqueous solution containing 34.0 g of potassium bromide and 8.9 mg of potassium hexacyanoferrate (II) were added for 30 minutes. The temperature was lowered, and desalting was carried out by a conventional method. After the desalting was completed, gelatin was added so as to give a concentration of 7% by weight, and the pH was adjusted to 6.2. The resulting emulsion was an emulsion comprising hexagonal tabular grains having a mean grain size of 1.29 μm, which was indicated by the sphere-corresponding diameter, a mean grain thickness of 0.27 μm and a mean aspect ratio of 8.5, which was obtained by dividing the projected diameter of grains by the thickness of grains. This emulsion was named emulsion A-1.

Emulsions A-2, A-3 and A-4 were prepared by the same preparation method as with emulsion A-1 with the exception that the form of grains was changed. An emulsion comprising hexagonal tabular grains having a mean grain size of 0.75 μm, which was indicated by the sphere-corresponding diameter, a mean grain thickness of 0.18 μm and a mean aspect ratio of 6.9 was named A-2, an emulsion comprising hexagonal tabular grains having a mean grain size of 0.52 μm, which was indicated by the sphere-corresponding diameter, a mean grain thickness of 0.18 μm and a mean aspect ratio of 4.0 was named A-3, and further, an emulsion comprising hexagonal tabular grains having a mean grain size of 0.44 μm, which was indicated by the sphere-corresponding diameter, a mean grain thickness of 0.18 μm and a mean aspect ratio of 3.1 was named A-4. However, the amounts of potassium hexachloroiridate (IV) and potassium hexacyanoferrate (II) added were changed in inverse proportion to the volume of grains, and the amount of p-acetamidobenzenesulfonate iodide monohydrate added was changed in proportion to the circumference of a grain.

Then, in a reaction vessel, 930 ml of distilled water containing 0.37 g of gelatin having an average molecular weight of 15000 and 0.7 g of potassium bromide was placed, and the temperature was elevated to 40° C. To this solution, 30 ml of an aqueous solution containing 0.34 g of silver nitrate and 30 ml of an aqueous solution containing 0.24 g of potassium bromide were added with vigorous stirring for 20 seconds. After the addition was completed, the temperature was kept at 40° C. for one minute. Then, the temperature of the reaction solution was elevated to 75° C. After 27.0 g of gelatin whose amino acids ware modified with trimellitic acid was added together with 200 ml of distilled water, 100 ml of an aqueous solution containing 23.36 g of silver nitrate and 80 ml of an aqueous solution containing 16.37 g of potassium bromide were added for 36 minutes while accelerating the addition flow rate. Then, 250 ml of an aqueous solution containing 83.2 g of silver nitrate and an aqueous solution containing potassium iodide and potassium bromide at a molar ratio of 3:97 (the concentration of potassium bromide: 26%) were added for 60 minutes while accelerating the addition flow rate and so that the silver potential of the reaction solution became −50 mV to the saturated calomel electrode. Further, 75 ml of an aqueous solution containing 18.7 g of silver nitrate and a 21.9% aqueous solution of potassium bromide were added for 10 minutes so that the silver potential of the reaction solution became 0 mV to the saturated calomel electrode. After the addition was completed, the temperature was kept at 75° C. for one minute. Then, the temperature of the reaction solution was lowered to 40° C. Then, 100 ml of an aqueous solution containing 10.5 g of sodium p-acetamidobenzenesulfonate iodide monohydrate was addled to adjust the pH of the reaction solution to 9.0. Then, 50 ml of an aqueous solution containing 4.3 g of sodium sulfite was added. After the addition was completed, the temperature was kept at 40° C. for 3 minutes. Then, the temperature of the reaction solution was elevated to 55° C. After the pH of the reaction solution was adjusted to 5.8, 0.8 mg of sodium benzenethiosulfinate, 0.04 mg of potassium hexachloroiridate (IV) and 5.5 g of potassium bromide were added, and the temperature was kept at 55° C. for one minute. Then, 180 ml of an aqueous solution containing 44.3 g of silver nitrate and 160 ml of an aqueous solution containing 34.0 g of potassium bromide and 8.9 mg of potassium hexacyanoferrate (II) were added for 30 minutes. The temperature was lowered, and desalting was carried out by a conventional method. After the desalting was completed, gelatin was added so as to give a concentration of 7% by weight, and the pH was adjusted to 6.2.

The resulting emulsion was an emulsion comprising hexagonal tabular grains having a mean grain size of 1.29 μm, which was indicated by the sphere-corresponding diameter, a mean grain thickness of 0.13 μm and a mean aspect ratio of 25.4. This emulsion was named emulsion A-5

Emulsions A-6, A-7 and A-8 were prepared by the same preparation method as with emulsion A-5 with the exception that the form of grains was changed. An emulsion comprising hexagonal tabular grains having a mean grain size of 0.75 μm, which was indicated by the sphere-corresponding diameter, a mean grain thickness of 0.11 μm and a mean aspect ratio of 14.0 was named A-6, an emulsion comprising hexagonal tabular grains having a mean grain size of 0.52 μm, which was indicated by the sphere-corresponding diameter, a mean grain thickness of 0.09 μm and a mean aspect ratio of 11.3 was named A-7, and further, an emulsion comprising hexagonal tabular grains having a mean grain size of 0.44 μm, which was indicated by the sphere-corresponding diameter, a mean grain thickness of 0.07 μm and a mean aspect ratio of 10.5 was named A-8. However, the amounts of potassium hexachloroiridate (IV) and potassium hexacyanoferrate (II) added were changed in inverse proportion to the volume of grains, and the amount of p-acetamidobenzenesulfonate iodide monohydrate added was changed in proportion to the circumference of a grain.

To emulsion A-1, 5.6 ml of a 1% aqueous solution of potassium iodide was added at 40° C., and then, $6.1\times10^{-4}$ mol of the following spectral sensitizing dye, compound I, potassium thiocyanate, chloroauric acid, sodium thiosulfate and mono (pentafluorophenyl) diphenylphosphine selenide were added to conduct spectral sensitization and chemical sensitization. After the chemical sensitization was completed, $1.2\times10^{-4}$ mol of stabilizer S was added. At this time, the amounts of the chemical sensitizers were adjusted so that the degree of chemical sensitization of the emulsion was optimized.

Blue-Sensitive Sensitizing Dye

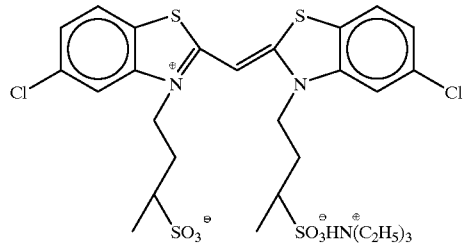

-continued

Compound I

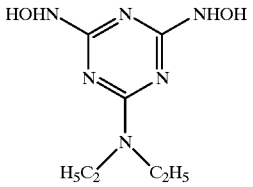

Stabilizer S (a mixture of the following)

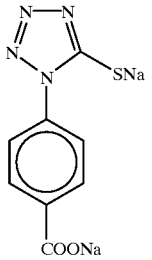

$2 \times 10^{-4}$ mol/mol Ag based on emulsion A-1

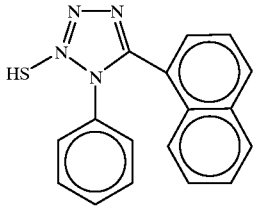

$8 \times 10^{-5}$ mol/mol Ag

The blue-sensitive emulsion thus prepared was named A-1b. Similarly, spectral sensitization and chemical sensitization were applied to the respective emulsions to prepare emulsions A-2b, A-3b, A-4b, A-5b, A-6b, A-7b and A-8b. However, the amount of the spectral sensitizing dye was changed according to the surface area of grains contained in each emulsion. Further, the amounts of the respective agents used in chemical sensitization were adjusted so that the degree of chemical sensitization of each emulsion was optimized.

Similarly, the spectral sensitizing dye was chanced, thereby preparing green-sensitive emulsions A-1g, A-2g, A-3g, A-4g, A-5g, A-6g, A-7g and A-8g, red-sensitive emulsions A-1r, A-2r, A-3r, A-4r, A-5r, A-6r, A-7r and A-8r, Sensitizing Dye I for Green-Sensitive Emulsion

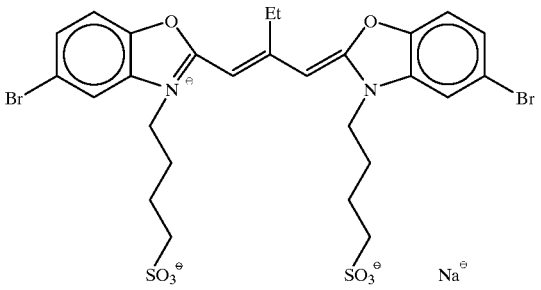

$5.5 \times 10^{-4}$ mol/mol Ag based on emulsion A-1

Sensitizing Dye II for Green-Sensitive Emulsion

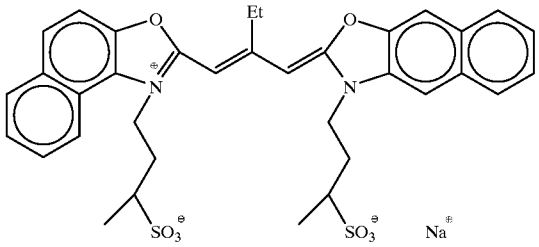

$1.3 \times 10^{-4}$ mol/mol Ag based on emulsion A-1

Sensitizing Dye III for Green-Sensitive Emulsion

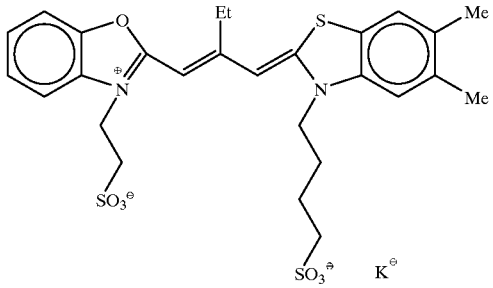

$4.8 \times 10^{-5}$ mol/mol Ag based on emulsion A-1

Red-Sensitive Sensitizing Dye

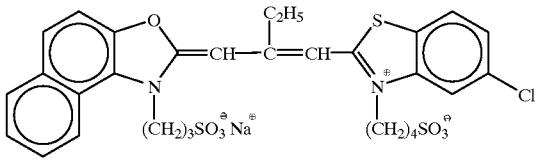

$2.5 \times 10^{-4}$ mol based on emulsion A-1

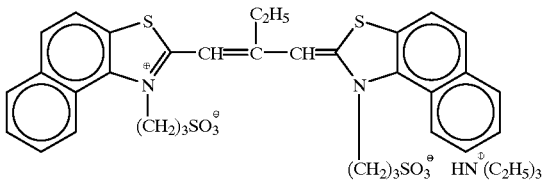

$6.3 \times 10^{-5}$ mol based on emulsion A-1

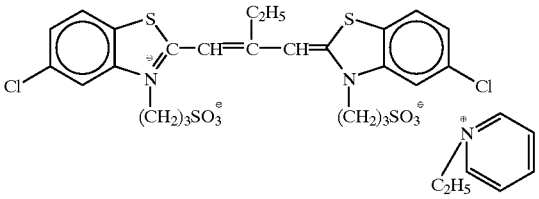

$3.1 \times 10^{-4}$ mol based on emulsion A-1

Then, a dispersion of zinc hydroxide using as a base precursor was prepared. Thirty-one grams of zinc hydroxide powder having a primary grain size of 0.2 $\mu$m, 1.6 g of carboxymethyl cellulose and 0.4 g of sodium polyacrylate as dispersing agents, 8.5 g of lime-treated ossein gelatin and 158.5 ml of water were mixed, and the resulting mixture was dispersed in a mill using glass beads for one hour. After the dispersion, the glass beads were filtered off to obtain 188 g of a dispersion of zinc hydroxide.

Further, emulsified dispersions containing couplers and incorporated developing agents were prepared.

First, 8.95 g of yellow coupler (a), 7.26 g of developing agent (b), 1.47 g of developing agent (c), 0.17 g of antifoggant (d) and 0.28 g of antifoggant (e) were dissolved in 18.29 g of high boiling organic solvent (f) and 50.0 ml of ethyl acetate at 60° C. The resulting solution was mixed with 200 g of an aqueous solution in which 18.0 g of lime-treated gelatin and 0.8 g of sodium dodecylbenzenesulfonate were dissolved, and dispersed by emulsification with a dissolver stirrer at 10000 rpm for 20 minutes. After the dispersion, distilled water was added to bring the total amount to 300 g, followed by mixing at 2000 rpm for 10 minutes.

Yellow Coupler (a)

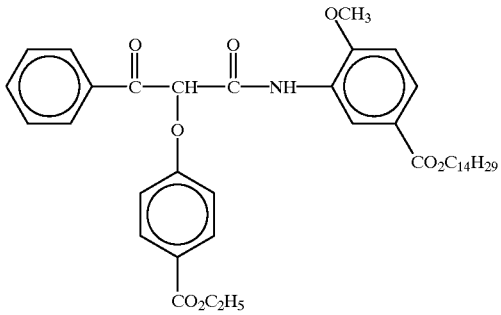

Developing Agent (b)

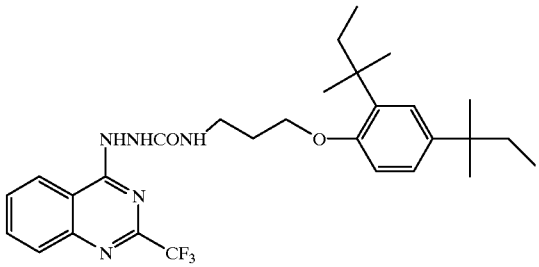

Developing Agent (c)

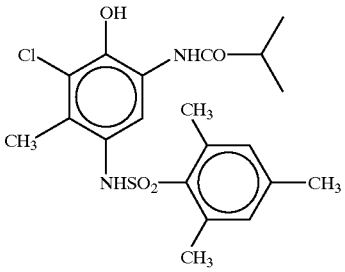

-continued

Antifoggant (d)

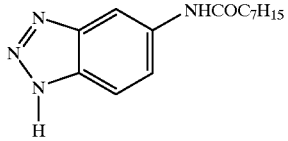

Antifoggant (e)

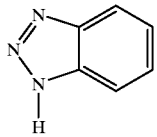

High Boiling Organic Solvent (f)

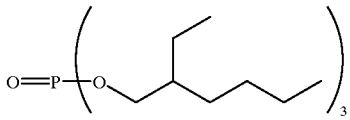

Then, similarly, a magenta coupler dispersion and a cyan coupler dispersion were also prepared.

First, 7.56 g of magenta coupler (g), 1.12 g of magenta coupler (h), 8.13 g of developing agent (i), 1.05 g of developing agent (c) and 0.11 g of antifoggant (d) were dissolved in 7.52 g of high boiling organic solvent (j) and 38.0 ml of ethyl acetate at 60° C. The resulting solution was mixed with 150 g of an aqueous solution in which 12.2 g of lime-treated gelatin and 0.8 g of sodium dodecylbenzenesulfonate were dissolved, and dispersed by emulsification with a dissolver stirrer at 10000 rpm for 20 minutes. After the dispersion, distilled water was added to bring the total amount to 300 g, followed by mixing at 2000 rpm for 10 minutes.

Then, 10.78 g of cyan coupler (k), 8.23 g of developing agent (i), 1.06 g of developing agent (c) and 0.15 g of antifoggant (d) were dissolved in 8.27 g of high boiling organic solvent (j) and 38.0 ml of ethyl acetate at 60° C. The resulting solution was mixed with 150 g of an aqueous solution in which 12.2 g of lime-treated gelatin and 0.8 g of sodium dodecylbenzenesulfonate were dissolved, and dispersed by emulsification with a dissolver stirrer at 10000 rpm for 20 minutes. After the dispersion, distilled water was added to bring the total amount to 300 g, followed by mixing at 2000 rpm for 10 minutes.

Magenta Coupler (g)
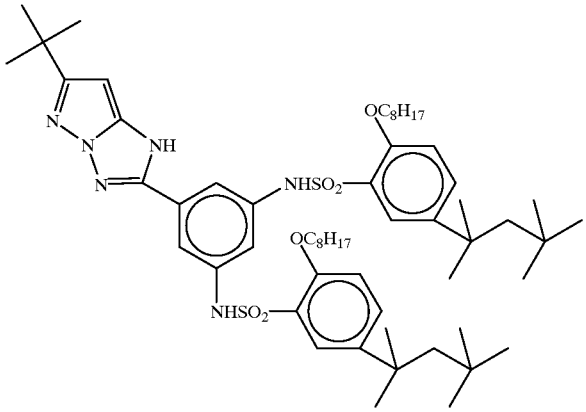
Magenta Coupler (h)
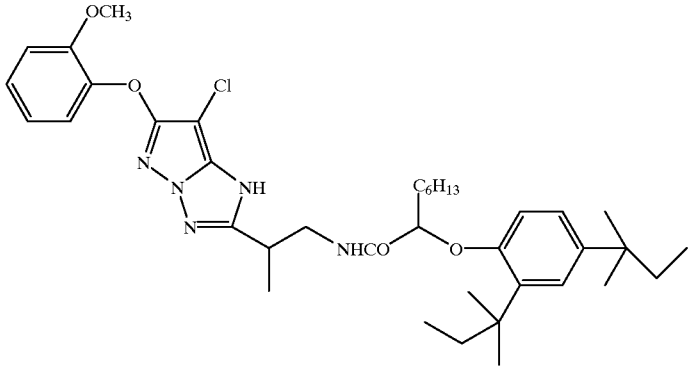
Developing Agent (i)
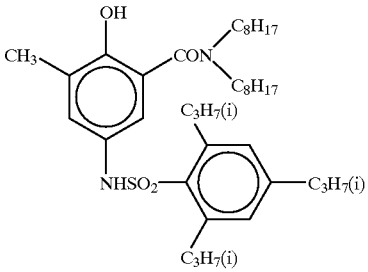
High Boiling Organic Solvent (j)
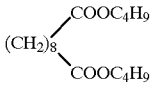
Cyan Coupler (k)
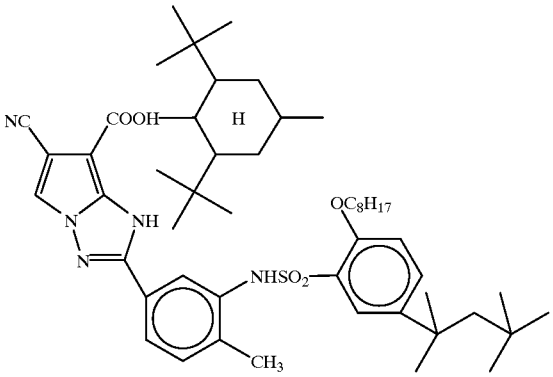

Further, dye dispersions for coloring intermediate layers as filter layers and an antihalation layer were similarly prepared Respective dyes and high boiling organic solvents used for dispersing them are shown below.

Yellow Dye (l)

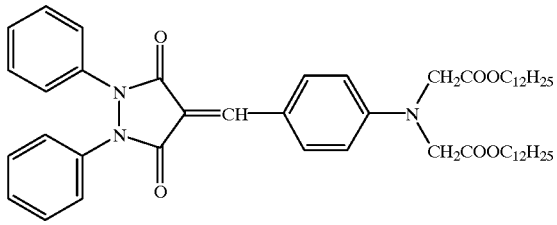

High Boiling Organic Solvent (m)

A 1:1 mixture of

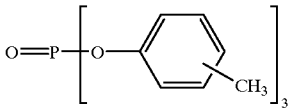

and Empara K65 (Ajinomoto Co., Inc.)

Magenta Dye (n)

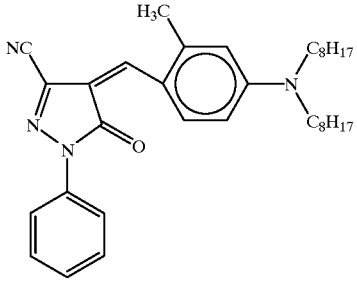

High Boiling Organic Solvent (o)

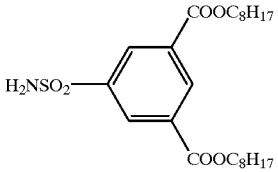

Cyan Dye (p)

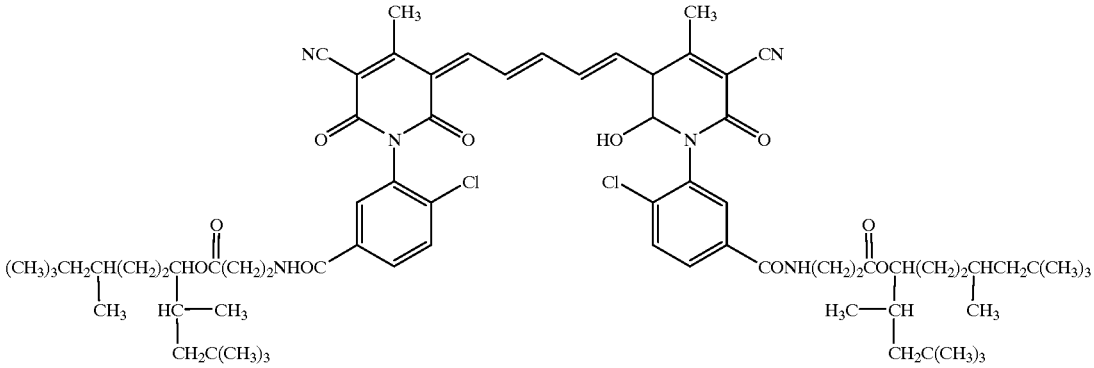

High Boiling Organic Solvent (Q)

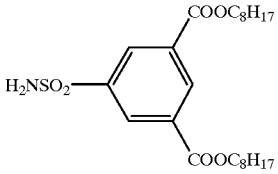

Supports were coated with compositions shown in Table 1 by a combination of these dispersions and the previously prepared silver halide emulsions to prepare multilayer color negative photographic materials of samples 101 to 109.

| | Sample 101 | Sample 102 | Sample 103 | Sample 104 | Sample 105 | Sample 106 | Sample 107 | Sample 108 | Sample 109 |
|---|---|---|---|---|---|---|---|---|---|
| Protective Layer | | | | | | | | | |
| Lime-Treated Gelatin | 914 | 914 | 914 | 914 | 914 | 914 | 914 | 914 | 914 |
| Matte Agent (Silica) | 50 | 50 | 50 | 50 | 50 | 50 | 50 | 50 | 50 |
| Surfactant (g) | 30 | 30 | 30 | 30 | 30 | 30 | 30 | 30 | 30 |
| Surfactant (r) | 40 | 40 | 40 | 40 | 40 | 40 | 40 | 40 | 40 |
| Water-Soluble polymer (s) | 15 | 15 | 15 | 15 | 15 | 15 | 15 | 15 | 15 |
| Hardener (t) | 110 | 110 | 110 | 110 | 110 | 110 | 110 | 110 | 110 |
| Intermediate Layer | | | | | | | | | |
| Lime-Treated Gelatin | 461 | 461 | 461 | 461 | 461 | 461 | 461 | 461 | 461 |
| Surfactant (r) | 5 | 5 | 5 | 5 | 5 | 5 | 5 | 5 | 5 |
| Zinc Hydroxide | 340 | 340 | 340 | 340 | 340 | 340 | 340 | 340 | 340 |
| Formalin Scavenger (u) | 300 | 300 | 300 | 300 | 300 | 300 | 300 | 300 | 300 |
| Water-Soluble Polymer (s) | 15 | 15 | 15 | 15 | 15 | 15 | 15 | 15 | 15 |
| Yellow Color Forming Layer High-Sensitivity Layer) | | | | | | | | | |
| Lime-Treated Gelatin | 1750 | 1750 | 1750 | 1750 | 1750 | 1750 | 1750 | 1750 | 1750 |
| Emulsion-1 (in terms | A-1b | A-5b | A-5b | A-5b | A-5b | A-5b | A-5b | A-5b | A-5b |
| of silver coated) | 220 | 220 | 550 | 550 | 550 | 550 | 220 | 220 | 330 |
| Emulsion-1 (in terms | A-2b | A-6b | — | — | — | — | A-6b | A-6b | A-6b |
| of silver coated) | 330 | 330 | | | | | 330 | 330 | 220 |
| Yellow Coupler (a) | 298 | 298 | 298 | 99 | 180 | 140 | 253 | 176 | 176 |
| Developing Agent (b) | 242 | 242 | 242 | 242 | 242 | 242 | 242 | 242 | 242 |
| Developing Agent (c) | 50 | 50 | 50 | 50 | 50 | 50 | 50 | 50 | 50 |
| Antifoggant (d) | 5.8 | 5.8 | 5.8 | 5.8 | 5.8 | 5.8 | 5.8 | 5.8 | 5.8 |
| Antifoggant (e) | 9.5 | 9.5 | 9.5 | 9.5 | 9.5 | 9.5 | 9.5 | 9.5 | 9.5 |
| High Boiling Organic Solvent (f) | 500 | 500 | 500 | 300 | 400 | 350 | 450 | 380 | 380 |
| Surfactant (y) | 27 | 27 | 27 | 16 | 22 | 19 | 24 | 20 | 20 |
| Water-Soluble Polymer (s) | 1 | 1 | 1 | 1 | 1 | 1 | 1 | 1 | 1 |
| Yellow Color Forming Layer (Middle-Sensitivity Layer) | | | | | | | | | |
| Lime-Treated Gelatin | 1400 | 1400 | 1400 | 1400 | 1400 | 1400 | 1400 | 1400 | 1400 |
| Emulsion-1 (in terms | A-2b | A-6b | A-6b | A-6b | A-6b | A-6b | A-6b | A-6b | A-6b |
| of silver coated) | 100 | 100 | 200 | 200 | 200 | 200 | 100 | 100 | 150 |
| Emulsion-1 (in terms | A-3b | A-7b | A-7b | A-7b | A-7b | A-7b | A-7b | A-7b | A-7b |
| of silver coated) | 150 | 150 | 50 | 50 | 50 | 50 | 150 | 150 | 100 |
| Yellow Coupler (a) | 277 | 277 | 277 | 95 | 168 | 179 | 235 | 163 | 163 |
| Developing Agent (b) | 225 | 225 | 225 | 225 | 225 | 225 | 225 | 225 | 225 |
| Developing Agent (c) | 46 | 46 | 46 | 46 | 46 | 46 | 46 | 46 | 46 |
| Antifoggant (d) | 5.3 | 5.3 | 5.3 | 5.3 | 5.3 | 5.3 | 5.3 | 5.3 | 5.3 |
| Antifoggant (e) | 8.8 | 8.8 | 8.8 | 8.8 | 8.8 | 8.8 | 8.8 | 8.8 | 8.8 |
| High Boiling Organic Solvent (f) | 566 | 566 | 566 | 300 | 450 | 375 | 510 | 440 | 440 |
| Surfactant (y) | 25 | 25 | 25 | 15 | 20 | 16 | 22 | 19 | 19 |
| Water-Soluble Polymer (s) | 2 | 2 | 2 | 2 | 2 | 2 | 2 | 2 | 2 |
| Yellow Color Forming Layer (Low-Sensitivity Layer) | | | | | | | | | |
| Lime-Treated Gelatin | 1400 | 1400 | 1400 | 1400 | 1400 | 1400 | 1400 | 1400 | 1400 |
| Emulsion-1 (in terms | A-3b | A-7b | A-7b | A-7b | A-7b | A-7b | A-7b | A-7b | A-7b |
| of silver coated) | 80 | 80 | 160 | 160 | 160 | 160 | 80 | 80 | 120 |
| Emulsion-1 (in terms | A-4b | A-8b | A-8b | A-8b | A-8b | A-8b | A-8b | A-8b | A-8b |
| of silver coated) | 120 | 120 | 40 | 40 | 40 | 40 | 120 | 120 | 80 |
| Yellow Coupler (a) | 277 | 277 | 277 | 95 | 167 | 179 | 235 | 163 | 163 |
| Developing Agent (b) | 225 | 225 | 225 | 225 | 225 | 225 | 225 | 225 | 225 |
| Developing Agent (c) | 46 | 46 | 46 | 46 | 46 | 46 | 46 | 46 | 46 |
| Antifoggant (d) | 5.3 | 5.3 | 5.3 | 5.3 | 5.3 | 5.3 | 5.3 | 5.3 | 5.3 |
| Antifoggant (e) | 8.8 | 8.8 | 8.8 | 8.8 | 8.8 | 8.8 | 8.8 | 8.8 | 8.8 |
| High Boiling Organic Solvent (f) | 566 | 566 | 566 | 300 | 455 | 378 | 510 | 440 | 440 |
| Surfactant (y) | 25 | 25 | 25 | 15 | 20 | 17 | 22 | 22 | 22 |
| Water-Soluble Polymer (s) | 2 | 2 | 2 | 2 | 2 | 2 | 2 | 2 | 2 |
| Intermediate Layer (Yellow Filter Layer) | | | | | | | | | |
| Lime-Treated Gelatin | 560 | 560 | 560 | 560 | 560 | 560 | 560 | 560 | 560 |
| Surfactant (y) | 15 | 15 | 15 | 15 | 15 | 15 | 15 | 15 | 15 |
| Surfactant (r) | 24 | 24 | 24 | 24 | 24 | 24 | 24 | 24 | 24 |

-continued

| | Sample 101 | Sample 102 | Sample 103 | Sample 104 | Sample 105 | Sample 106 | Sample 107 | Sample 108 | Sample 109 |
|---|---|---|---|---|---|---|---|---|---|
| Dye (1) | 85 | 85 | 85 | 85 | 85 | 85 | 85 | 85 | 85 |
| High Boiling Organic Solvent (m) | 85 | 85 | 85 | 85 | 85 | 85 | 85 | 85 | 85 |
| Zinc Hydroxide | 125 | 125 | 125 | 125 | 125 | 125 | 125 | 125 | 125 |
| Water-Soluble Polymer (s) | 15 | 15 | 15 | 15 | 15 | 15 | 15 | 15 | 15 |
| Magenta Color Forming Layer (High-Sensitivity Layer) | | | | | | | | | |
| Lime-Treated Gelatin | 781 | 781 | 781 | 781 | 781 | 781 | 781 | 781 | 781 |
| Emulsion-1 (in terms of silver coated) | A-1g 240 | A-5g 240 | A-5g 780 | A-5g 780 | A-5g 780 | A-5g 780 | A-5g 240 | A-5g 240 | A-5g 540 |
| Emulsion-1 (in terms of silver coated) | A-2g 540 | A-6g 540 | — | — | — | — | A-6g 540 | A-6g 540 | A-6g 240 |
| Magenta Coupler (g) | 80 | 80 | 80 | 28 | 48 | 38 | 68 | 56 | 56 |
| Magenta Coupler (h) | 12 | 12 | 12 | 4 | 7 | 6 | 10 | 10 | 10 |
| Developing Agent (i) | 85 | 85 | 85 | 85 | 85 | 85 | 85 | 85 | 85 |
| Developing Agent (c) | 11 | 11 | 11 | 11 | 11 | 11 | 11 | 11 | 11 |
| Antifoggant (d) | 1.2 | 1.2 | 1.2 | 1.2 | 1.2 | 1.2 | 1.2 | 1.2 | 1.2 |
| High Boiling Organic Solvent (j) | 79 | 79 | 79 | 48 | 64 | 56 | 72 | 62 | 62 |
| Surfactant (y) | 8 | 8 | 8 | 4 | 6 | 5 | 7 | 6 | 6 |
| Water-Soluble Polymer (s) | 8 | 8 | 8 | 8 | 8 | 8 | 8 | 8 | 8 |
| Magenta Color Forming Layer (Middle-Sensitivity Layer) | | | | | | | | | |
| Lime-Treated Gelatin | 659 | 659 | 659 | 659 | 659 | 659 | 659 | 659 | 659 |
| Emulsion-1 (in terms of silver coated) | A-2g 250 | A-6g 250 | A-6g 500 | A-6g 500 | A-6g 500 | A-6g 500 | A-6g 250 | A-6g 250 | A-6g 400 |
| Emulsion-1 (in terms of silver coated) | A-3g 400 | A-7g 400 | A-7g 150 | A-7g 150 | A-7g 150 | A-7g 150 | A-7g 400 | A-7g 400 | A-7g 250 |
| Magenta Coupler (g) | 103 | 103 | 103 | 35 | 63 | 49 | 88 | 62 | 62 |
| Magenta Coupler (h) | 15 | 15 | 15 | 7 | 9 | 8 | 13 | 10 | 10 |
| Developing Agent (i) | 110 | 110 | 110 | 110 | 110 | 110 | 110 | 88 | 88 |
| Developing Agent (c) | 14 | 14 | 14 | 14 | 14 | 14 | 14 | 14 | 14 |
| Antifoggant (d) | 1.5 | 1.5 | 1.5 | 1.5 | 1.5 | 1.5 | 1.5 | 1.5 | 1.5 |
| High Boiling Organic Solvent (j) | 102 | 102 | 102 | 60 | 82 | 71 | 92 | 80 | 80 |
| Surfactant (y) | 11 | 11 | 11 | 7 | 9 | 8 | 10 | 10 | 10 |
| Water-Soluble Polymer (s) | 14 | 14 | 14 | 14 | 14 | 14 | 14 | 14 | 14 |
| Magenta Color Forming Layer (Low-Sensitivity Layer) | | | | | | | | | |
| Lime-Treated Gelatin | 711 | 711 | 711 | 711 | 711 | 711 | 711 | 711 | 711 |
| Emulsion-1 (in terms of silver coated) | A-3g 100 | A-7g 100 | A-7g 190 | A-7g 190 | A-7g 190 | A-7g 190 | A-7g 100 | A-7g 100 | A-7g 140 |
| Emulsion-1 (in terms of silver coated) | A-4g 140 | A-8g 140 | A-8g 50 | A-8g 50 | A-8g 50 | A-8g 50 | A-8g 140 | A-8g 140 | A-8g 100 |
| Magenta Coupler (g) | 274 | 274 | 274 | 100 | 165 | 133 | 233 | 163 | 163 |
| Magenta Coupler (h) | 40 | 40 | 40 | 15 | 25 | 20 | 34 | 24 | 24 |
| Developing Agent (i) | 291 | 291 | 291 | 291 | 291 | 291 | 291 | 291 | 291 |
| Developing Agent (c) | 36 | 38 | 38 | 38 | 38 | 38 | 38 | 38 | 38 |
| Antifoggant (d) | 3.9 | 3.9 | 3.9 | 3.9 | 3.9 | 3.9 | 3.9 | 3.9 | 3.9 |
| High Boiling Organic Solvent (j) | 269 | 269 | 269 | 190 | 215 | 203 | 243 | 207 | 207 |
| Surfactant (y) | 29 | 29 | 29 | 20 | 23 | 22 | 27 | 23 | 23 |
| Water-Soluble Polymer (s) | 14 | 14 | 14 | 14 | 14 | 14 | 14 | 14 | 14 |
| Intermediate Layer (Magenta Filter Layer) | | | | | | | | | |
| Lime-Treated Gelatin | 850 | 850 | 850 | 850 | 850 | 850 | 850 | 850 | 850 |
| Surfactant (y) | 15 | 15 | 15 | 15 | 15 | 15 | 15 | 15 | 15 |
| Surfactant (r) | 24 | 24 | 24 | 24 | 24 | 24 | 24 | 24 | 24 |
| Dye (n) | 200 | 200 | 200 | 200 | 200 | 200 | 200 | 200 | 200 |
| High Boiling Organic Solvent (c) | 200 | 200 | 200 | 200 | 200 | 200 | 200 | 200 | 200 |
| Formalin Scavenger (u) | 300 | 300 | 300 | 300 | 300 | 300 | 300 | 300 | 300 |
| Zinc Hydroxide | 2028 | 2028 | 2028 | 2028 | 2028 | 2028 | 2028 | 2028 | 2028 |
| Water-Soluble Polymer (a) | 15 | 15 | 15 | 15 | 15 | 15 | 15 | 15 | 15 |
| Cyan Color Forming Layer (High-Sensitivity Layer) | | | | | | | | | |
| Lime-Treated Gelatin | 842 | 842 | 842 | 842 | 842 | 842 | 842 | 842 | 842 |
| Emulsion-1 (in terms of silver coated) | A-1r 400 | A-5r 400 | A-5r 1000 | A-5r 1000 | A-5r 1000 | A-5r 1000 | A-5r 400 | A-5r 400 | A-5r 600 |
| Emulsion-1 (in terms of silver coated) | A-2r 600 | A-6r 600 | — | — | — | — | A-6r 600 | A-6r 600 | A-6r 400 |

-continued

| | Sample 101 | Sample 102 | Sample 103 | Sample 104 | Sample 105 | Sample 106 | Sample 107 | Sample 108 | Sample 109 |
|---|---|---|---|---|---|---|---|---|---|
| Cyan Coupler (k) | 64 | 64 | 64 | 22 | 39 | 31 | 54 | 38 | 38 |
| Developing Agent (i) | 75 | 75 | 75 | 75 | 75 | 75 | 75 | 75 | 75 |
| Developing Agent (c) | 6 | 6 | 6 | 6 | 6 | 6 | 6 | 6 | 6 |
| Antifoggant (d) | 0.9 | 0.9 | 0.9 | 0.9 | 0.9 | 0.9 | 0.9 | 0.9 | 0.9 |
| High Boiling Organic Solvent (j) | 49 | 49 | 49 | 18 | 39 | 29 | 45 | 38 | 38 |
| Surfactant (y) | 5 | 5 | 5 | 3 | 4 | 3 | 5 | 4 | 4 |
| Water-Soluble Polymer (s) | 18 | 18 | 18 | 18 | 18 | 18 | 18 | 18 | 18 |
| Cyan Color Forming Layer (Middle-Sensitivity Layer) | | | | | | | | | |
| Lime-Treated Gelatin | 475 | 475 | 475 | 475 | 475 | 475 | 475 | 475 | 475 |
| Emulsion-1 (in terms | A-2r | A-6r | A-6r | A-6r | A-6r | A-6r | A-6r | A-6r | A-6r |
| of silver coated) | 240 | 240 | 500 | 500 | 500 | 500 | 240 | 240 | 360 |
| Emulsion-1 (in terms | A-3r | A-7r | A-7r | A-7r | A-7r | A-7r | A-7r | A-7r | A-7r |
| of silver coated) | 360 | 360 | 100 | 100 | 100 | 100 | 360 | 360 | 240 |
| Cyan Coupler (k) | 134 | 134 | 134 | 46 | 82 | 87 | 114 | 97 | 97 |
| Developing Agent (i) | 102 | 102 | 102 | 102 | 102 | 102 | 102 | 102 | 102 |
| Developing Agent (c) | 13 | 13 | 13 | 13 | 13 | 13 | 13 | 13 | 13 |
| Antifoggant (d) | 1.9 | 1.9 | 1.9 | 1.9 | 1.9 | 1.9 | 1.9 | 1.9 | 1.9 |
| High Boiling Organic Solvent (j) | 103 | 103 | 103 | 77 | 83 | 80 | 92 | 78 | 78 |
| Surfactant (y) | 10 | 10 | 10 | 7 | 8 | 8 | 9 | 8 | 8 |
| Water-Soluble Polymer (s) | 15 | 15 | 15 | 15 | 15 | 15 | 15 | 15 | 15 |
| Cyan Color Forming Layer (Low-Sensitivity Layer) | | | | | | | | | |
| Lime-Treated Gelatin | 825 | 825 | 825 | 825 | 825 | 825 | 825 | 825 | 825 |
| Emulsion-1 (in terms | A-3r | A-7r | A-7r | A-7r | A-7r | A-7r | A-7r | A-7r | A-7r |
| of silver coated) | 180 | 180 | 300 | 300 | 300 | 300 | 180 | 180 | 270 |
| Emulsion-1 (in terms | A-4r | A-8r | A-8r | A-8r | A-8r | A-8r | A-8r | A-8r | A-8r |
| of silver coated) | 270 | 270 | 150 | 150 | 150 | 150 | 270 | 270 | 180 |
| Cyan Coupler (k) | 234 | 234 | 234 | 82 | 141 | 111 | 199 | 139 | 139 |
| Developing Agent (i) | 179 | 179 | 179 | 179 | 179 | 179 | 179 | 179 | 179 |
| Developing Agent (c) | 23 | 23 | 23 | 23 | 23 | 23 | 23 | 23 | 23 |
| Antifoggant (d) | 3.3 | 3.3 | 3.3 | 3.3 | 3.3 | 3.3 | 3.3 | 3.3 | 3.3 |
| High Boiling Organic Solvent (j) | 179 | 179 | 179 | 140 | 143 | 142 | 163 | 139 | 139 |
| Surfactant (y) | 17 | 17 | 17 | 13 | 14 | 14 | 16 | 14 | 14 |
| Water-Soluble Polymer (s) | 10 | 10 | 10 | 10 | 10 | 10 | 10 | 10 | 10 |
| Antihalation Layer | | | | | | | | | |
| Lime-Treated Gelatin | 440 | 440 | 440 | 440 | 440 | 440 | 440 | 440 | 440 |
| Surfactant (y) | 14 | 14 | 14 | 14 | 14 | 14 | 14 | 14 | 14 |
| Dye (p) | 260 | 260 | 260 | 260 | 260 | 260 | 260 | 260 | 260 |
| High Boiling Organic Solvent (o) | 260 | 260 | 260 | 260 | 260 | 260 | 260 | 260 | 260 |
| Water-Soluble Polymer (s) | 15 | 15 | 15 | 15 | 15 | 15 | 15 | 15 | 15 |

Transparent PET Base (96 $\mu$m)

Surfactant (q)

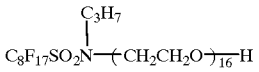

Surfactant (r)

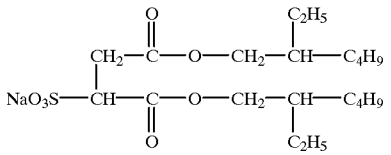

-continued

Water-Soluble Polymer (s)

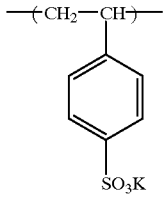

Hardener (t)

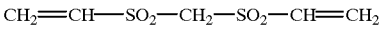

-continued

Formalin Scavenger (u)

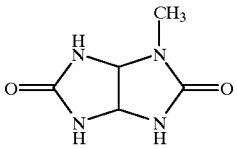

Further, processing members P-1 and P-2 as shown in Tables 2 and 3 were prepared.

TABLE 2

CONSTITUTION OF PROCESSING MEMBER P-1

| Layer Constitution | Addition Material | Amount Added ($mg/m^2$) |
|---|---|---|
| Fourth Layer | Acid-Treated Gelatin | 220 |
| Protective Layer | Water-Soluble Polymer (v) | 60 |
| | Water-Soluble Polymer (w) | 200 |
| | Additive (x) | 80 |
| | Potassium Nitrate | 16 |
| | Matte Agent (z) | 10 |
| | Surfactant (r) | 7 |
| | Surfactant (aa) | 7 |
| | Surfactant (ab) | 10 |
| Third Layer | Lime-Treated Gelatin | 240 |
| Intermediate Layer | Water-Soluble Polymer (w) | 24 |
| | Hardener (ac) | 180 |
| | Surfactant (y) | 9 |
| Second Layer | Lime-Treated Gelatin | 2100 |
| Base Generation Layer | Water-Soluble Polymer (w) | 360 |
| | Water-Soluble Polymer (ad) | 700 |
| | Water-Soluble Polymer (ae) | 600 |
| | High-Boiling Organic Solvent (af) | 2120 |
| | Additive (ag) | 20 |
| | Guanidine Picolinate | 2613 |
| | Potassium Quinolinate | 225 |
| | Sodium Quinolinate | 192 |
| | Surfactant (y) | 24 |
| First Layer | Lime-Treated Gelatin | 247 |
| Undercoat Layer | Water-Soluble Polymer (v) | 12 |
| | Surfactant (r) | 14 |
| | Hardener (ac) | 178 |

Transparent Support (63 $\mu$m)

TABLE 3

CONSTITUTION OF PROCESSING MEMBER P-2

| Layer Constitution | Addition Material | Amount Added ($mg/m^2$) |
|---|---|---|
| Fifth Layer | Acid-Treated Gelatin | 490 |
| Protective Layer | Matte Agent (z) | 10 |
| Fourth Layer | Lime-Treated Gelatin | 240 |
| Intermediate Layer | Hardener (ac) | 250 |
| Third Layer | Lime-Treated Gelatin | 4890 |
| Solvent Layer | Solvent (ah) for Silver Halide | 5770 |
| Second Layer | Lime-Treated Gelatin | 370 |
| Intermediate Layer | Hardener (ac) | 500 |
| First Layer | Lime-Treated Gelatin | 247 |
| Undercoat Layer | Water-Soluble Polymer (v) | 12 |
| | Surfactant (r) | 14 |
| | Hardener (ac) | 178 |

Transparent Support (63 $\mu$m)

Water-Soluble Polymer (v) K-Carageenan

Water-Soluble Polymer (w) Sumikagel L-5H (manufactured by Sumitomo Chemical Co., Ltd.)

Additive (x)

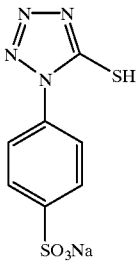

Surfactant (y)

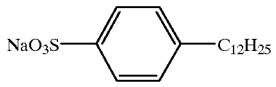

Matte Agent (z)

SYLOID79 manufactured by Fuji Davison Co.

Surfactant (aa)

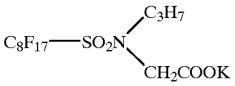

Surfactant (ab)

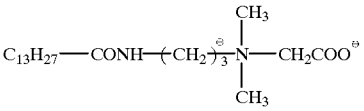

Hardener (ac)

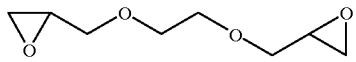

Water-Soluble Polymer (ad) Dextran (molecular weight: 70,000)

Water-soluble Polymer (ae) MP Polymer MP102 (manufactured by Kuraray Co., Ltd.)

High Boiling Solvent (af) Empara 40 (manufactured by Ajinomoto Co., Inc.)

Additive (ag)

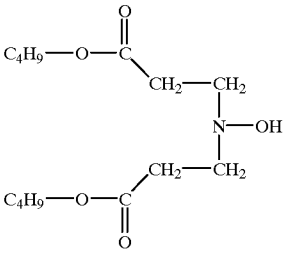

Solvent (ah) for Silver Halide

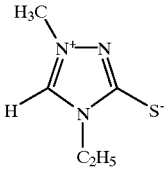

From these photographic materials, test pieces were cut out, and exposed through an optical wedge at 200 luxes for 1/100 second under the same conditions as those under which the characteristic of the present invention, the photographic sensitivity, was determined.

After the exposure, color development processing was conducted according to standard processing CN-16X for color negative films manufactured by by Fuji Photo Film Co., Ltd. At this time, two kinds of processing at 38° C. for 3 minutes and 15 seconds, the standard processing, and processing at 53° C. were carried out in a color developing bath. In the case of processing at 53° C., the development time was varied between 40 seconds and 70 seconds so as to give the sensitivity identical to that of the standard processing at 38° C. The ISO sensitivity and the average gradient were determined from the measurement of the transmission density of the samples after the processing.

On the other hand, hot water having a temperature of 40° C. was applied onto a surface of each photographic material after the exposure in an amount of 15 ml/m$^2$, and the photographic material was overlaid with processing member P-1 so that the layers face each other, followed by heat development at 83° C. using a heat drum. The development processing time of this heat development was between 10 seconds and 20 seconds, and determined by (hanging it so that the sensitivity becomes approximately similar to that in the case of standard processing CN-16X. After the development of each photographic material, a surface of the photographic material from which P-1 was separated was coated with water in an amount of 10 cc/m$^2$, and laminated with processing member P-2, followed by heating at 50° C. for 30 seconds.

Also for color formed samples obtained after the heat development, the transmission density was measured to determine the ISO sensitivity and the average gradient, in the same manner as with the above-mentioned samples after solution development.

Further, samples 101 to 109 were processed to the form specified by ix 240, and further processed from the color negative silver halide photographic materials accommodated in ix 240 cartridges to the form of a lens-mounted film (film with lens) The processing specification was similar to that of "Utsurundesu Super Slim (Fujicolor Quick Snap, Super Slim)" manufactured by Fuji Photo Film Co., Ltd., with the proviso that the lens mounted films were especially equipped with electronic flashes which were reduced in quantity of light to 25%, compared with ordinary ones.

Three lens-mounted films each loaded with test photographic materials were prepared for each sample. Using these, objects having Macbeth color checker charts were shot under various illumination conditions for every 25 frames. Each sample was subjected to three kinds of processings, the above-mentioned CN-16X processing at 38° C., processing at 50° C. and heat development at 83° C.

The contents of shooting conditions of 25 frames and the EV value of the main objects are shown in Table 4. The EV value was a value obtained by measuring light with a IV F type autometer manufactured by Minoruta Camera Co., Ltd.

TABLE 4

SHOOTING CONDITIONS

| Condition No. | Indoor/ Outdoor | Contents of Circumstances | EV Value |
|---|---|---|---|
| 1 | In | Under Streetlamp at night | 4.2 |
| 2 | In | Restaurant | 4.9 |
| 3 | In | Soccer Ground | 5.6 |
| 4 | In | Station Yard | 6.3 |
| 5 | In | Living Room | 6.5 |
| 6 | In | Lobby of Hotel | 7.8 |
| 7 | In | Office | 7.5 |

TABLE 4-continued

SHOOTING CONDITIONS

| Condition No. | Indoor/ Outdoor | Contents of Circumstances | EV Value |
|---|---|---|---|
| 8 | In | Office | 8.1 |
| 9 | In | Office | 9.5 |
| 10 | In | Photo Studio | 9.4 |
| 11 | In | Photo Studio | 11.2 |
| 12 | In | Photo Studio | 13.5 |
| 13 | Out | Cloudy, Entrance | 7.5 |
| 14 | Out | Cloudy, Precinct of Shrine | 9.3 |
| 15 | Out | Cloudy, Car Park | 11.1 |
| 16 | Out | Cloudy, Ground | 11.6 |
| 17 | Out | Cloudy, Beach | 12.5 |
| 18 | Out | Fair, Back Light | 11.2 |
| 19 | Out | Fair, Park | 12.4 |
| 20 | Out | Fair, Road | 13.0 |
| 21 | Out | Fair, Car Park | 13.4 |
| 22 | Out | Fine, Back Light | 11.7 |
| 23 | Out | Fine, Park | 14.6 |
| 24 | Out | Fine, Ground | 15.5 |
| 25 | Out | Fine, Beach | 16.8 |

The films processed were printed out to Fuji color digital paper using a digital color printer "Frontier" manufactured by Fuji Photo Film Co., Ltd. For the print samples obtained by applying the digital image processing, 10 evaluating members selected at random visually evaluated the image quality thereof. The evaluation was conducted by the evaluation system of classifying them into five grades (in the order of degree of satisfaction from 5 to 1), and the average of the above-mentioned 25 frames and 10 examining members was determined to take it as an image quality evaluation point (referred to as D print image quality).

Further, using 3 signals of B, G and R of 6 steps of a gray portion of the Macbeth checker chart contained in each image data read with a scanner of the Frontier printer, processing for allowing the density of the chart to agree with the original was carried out by use of a personal computer. After that, the image signals were converted to 8 bits, the density of respective image elements was indicated by 1 to 255, and the variation in density in each patch was calculated as RMS to take it as RMS granularity.

The RMS granularity was determined for the whole patches of 6 steps of Macbeth gray to each image, and represented as the average value thereof. This represents the granularity after reading with the image taking apparatus and digital image processing. A decrease in this value means the excellent granularity.

Further, it was tried that the negative films processed were printed on Fuji color FA paper with a printer processor PP400 for a mini processing laboratory manufactured by Fuji Photo Film Co., Ltd., and the approximate time required to print the 25 frames and the print image quality were checked. The image quality of prints obtained by applying the digital processing was evaluated by the evaluation system of classifying them into five grades (in the order of degree of satisfaction from 5 to 1) by 10 evaluating members, and indicated by the average of the above-mentioned 25 frames and 10 examining members (referred to as A print image quality).

Results thereof are summarized in Table 5.

TABLE 5

| Sample No. | ISO Sensitivity | γ | $\gamma\log_{10}S$ | RMS | D Print Image Quality | A Print Image Quality | A Print Time (min.) |
|---|---|---|---|---|---|---|---|
| | | | CN-16X (38° C., 3'15") | | | | |
| 101 | 640 | 0.80 | 2.24 | 13.5 | 2.8 | 3.3 | within 5 |
| 102 | 1000 | 0.82 | 2.46 | 11.6 | 3.0 | 3.0 | 7 |
| 103 | 1600 | 0.81 | 2.60 | 10.3 | 3.5 | 3.5 | 10 |
| 104 | 1600 | 0.25 | 0.80 | 10.9 | 3.3 | 2.3 | within 5 |
| 105 | 1600 | 0.50 | 1.60 | 9.5 | 3.8 | 3.2 | within 5 |
| 106 | 1600 | 0.38 | 1.22 | 10.2 | 3.6 | 3.1 | within 5 |
| 107 | 1000 | 0.70 | 2.10 | 11.6 | 3.2 | 2.8 | within 5 |
| 108 | 1000 | 0.48 | 1.44 | 11.3 | 3.0 | 2.5 | within 5 |
| 109 | 1250 | 0.52 | 1.61 | 11.6 | 3.5 | 2.9 | within 5 |
| | | | CN-16X (53° C.) | | | | |
| 101 | 640 | 0.81 | 2.27 | 13.2 | 3.7 | 3.5 | within 5 |
| 102 | 1000 | 0.80 | 2.40 | 11.8 | 3.2 | 3.1 | 8 |
| 103 | 1600 | 0.83 | 2.66 | 10.1 | 3.5 | 3.4 | 12 |
| 104 | 1600 | 0.27 | 0.86 | 10.7 | 3.3 | 2.6 | within 5 |
| 105 | 1600 | 0.51 | 1.63 | 8.5 | 4.3 | 3.4 | within 5 |
| 106 | 1600 | 0.38 | 1.22 | 9.0 | 4.2 | 3.2 | within 5 |
| 107 | 1000 | 0.71 | 2.13 | 9.6 | 3.9 | 3.0 | within 5 |
| 108 | 1000 | 0.49 | 1.47 | 9.3 | 4.0 | 3.1 | within 5 |
| 109 | 1250 | 0.53 | 1.64 | 9.9 | 4.1 | 3.3 | within 5 |
| | | | Heat Development (83° C.) | | | | |
| 101 | 640 | 0.85 | 2.39 | 12.8 | 3.6 | 3.2 | 6 |
| 102 | 1000 | 0.85 | 2.55 | 11.5 | 3.4 | 3.0 | 10 |
| 103 | 1600 | 0.84 | 2.69 | 9.8 | 3.6 | 3.4 | 20 |
| 104 | 1600 | 0.28 | 0.90 | 10.3 | 3.5 | 2.5 | within 5 |
| 105 | 1600 | 0.51 | 1.63 | 7.4 | 4.7 | 3.2 | within 5 |
| 106 | 1600 | 0.39 | 1.25 | 8.2 | 4.6 | 3.0 | within 5 |
| 107 | 1000 | 0.72 | 2.16 | 9.0 | 4.1 | 3.0 | within 5 |
| 108 | 1000 | 0.49 | 1.47 | 8.8 | 4.3 | 3.1 | within 5 |
| 109 | 1250 | 0.55 | 1.70 | 8.7 | 4.4 | 3.4 | within 5 |

Data surrounded by the line indicate the results of this invention.

Data surrounded by the line indicate the results of this invention.

From these results, the significant effects of the present invention can be seen.

First, with respect to sample 101 having an ISO sensitivity of less than 800, images shot under the conditions that the EV value was less than 7 were apparently underexposed. Even when the contrast was adjusted by digital processing, granular roughness was significant, resulting in a low evaluation point of image quality.

Even when the ISO sensitivity was as high as 1600, for sample 103 in which the value of $(\log_{10}S)\cdot\gamma$ exceeded 2.5, the printing time in a mini processing laboratory equipped with a usual analog printer was extremely prolonged, and even reading with the "Frontier" printer, a digital printer, results in deteriorated granularity because of much reading noise particularly for images shot at an EV value of 14 or more, leading to a low evaluation point of image quality.

On the other hand, when sample 104 in which the value of $(\log_{10}S)\cdot\gamma$ is less than 1.0 was printed with the analog printer, the contrast was so low that modulation was week. When the contrast was enhanced with the digital printer, the overall evaluation point did not become high because of increased granular roughness.

On the other hand, even when samples 105 to 109 were processed at high temperatures, analog processing also results in weak modulation, and no significant improvement in A print image quality was not observed.

In contrast, when samples 105 to 109 was subjected to high-temperature processing and digital image processing, the RMS value was depressed to a low level, and unexpectedly high evaluation points were also obtained in the evaluation of image quality. The samples subjected to heat development at 83° C. and digital image processing were particularly excellent, and the effects of the present invention were apparent.

According to the present invention, the images obtained by developing the silver halide photographic materials specified in sensitivity and gradient at high temperatures are subjected to digital image processing, thereby obtaining the color photographs of high image quality excellent in granularity and having a proper contrast.

What is claimed is:

1. An image formation method for forming a color image by imagewise exposing a color negative silver halide photographic material comprising a transparent support and at least three kinds of light-sensitive layers having thereon, followed by development processing at a temperature of 50° C. or more, which comprises the steps of:

reading with an image taking apparatus an image obtained from the color negative silver halide photographic material whose sensitivity and gradient satisfy the following relationship:

$$1.0 \leqq (\log_{10}S)\cdot\gamma \leqq 2.5$$

$$S \geqq 800;$$

applying digital image processing thereto; and obtaining output signals of three or more colors: wherein S represents an ISO sensitivity, and γ represents an average gradient of the three kinds of light-sensitive layers.

2. The image formation method according to claim 1, wherein the color negative silver halide photographic material is imagewise exposed using the photographic material and a processing member comprising a support and thereon at least a processing layer containing at least one of a base and a base precursor;

water corresponding to 0.1 to 1.0 time an amount necessary for swelling all coated layers except for back layers of both the photographic material and the processing member at their maximum is given to at least one of the photographic material and the processing member; and the photographic material is overlaid with the processing member in the form that the light-sensitive layer and the processing layer face to each other, followed by heating at a temperature of 50° C. to 100° C. for 5 seconds to 60 seconds to form a color image.

3. The image formation method according to claim 1, where the color negative silver halide material satisfies the following relationship: $1.3 \leqq (\log_{10}S)\cdot\gamma \leqq 2.0$.

4. The image formation method according to claim 1, wherein the color negative silver halide material has a silver coat amount of 2 g/cm$^2$ to 7 g/cm$^2$.

5. The image formation method according to claim 1, wherein the image taking apparatus has a CCD array.

6. The image formation method according to claim 1, wherein the color negative silver halide photographic material comprises at least one light-sensitive layer, and the at least one light-sensitive layer contains an emulsion in which tabular grains having an aspect ratio of 2 or more occupy 50% or more of the projected area of the whole grains.

7. The image formation method according to claim 6, wherein the tabular grains have a thickness of 0.3 μm or less.

* * * * *